US005766414A

United States Patent [19]

Alenius et al.

[11] Patent Number: 5,766,414

[45] Date of Patent: Jun. 16, 1998

[54] METHOD OF BLEACHING CELLULOSE PULP WITH PEROXIDE UNDER ELEVATED PRESSURE IN A FIRST VESSEL AND ATMOSPHERIC PRESSURE IN SECOND VESSEL

[75] Inventors: Markus Alenius, Pietarsaari; Kenneth Winberg, Jakobstad, both of Finland

[73] Assignee: Ahlstrom Machinery Oy, Helsinki, Finland

[21] Appl. No.: 603,590

[22] Filed: Feb. 16, 1996

[30] Foreign Application Priority Data

Feb. 21, 1995 [FI] Finland ..... 950785

[51] Int. Cl.[6] ..... D21C 7/06; D21C 7/08; D21C 9/147; D21C 9/16

[52] U.S. Cl. ..... 162/52; 162/65; 162/78

[58] Field of Search ..... 162/65, 19, 76, 162/78, 52, 57

[56] References Cited

FOREIGN PATENT DOCUMENTS

| | | | |
|---|---|---|---|
| 577157 | 6/1992 | European Pat. Off. . | |
| 94/20673 | 9/1994 | WIPO | 162/65 |
| WO 95/09945 | 4/1995 | WIPO . | |

OTHER PUBLICATIONS

Stromberg, 1994 Int. Pulp Bleaching Conf. Jun. 13–16, 1994.

Basta et al, "Alternatives For Bleaching High Brightness TCF Pulps", Int. Non–Chlorine Bleaching Conf. Mar. 6–10 1994.

*Primary Examiner*—Steven Alvo

*Attorney, Agent, or Firm*—Nixon & Vanderhye P.C.

[57] ABSTRACT

Bleaching of cellulose pulp with peroxide is accomplished and has the advantages of conventional pressurized peroxide bleaching without the need for a large pressurized vessel. Pulp at a consistency of between about 8–20% is mixed with peroxide and introduced into a first relatively-small treatment vessel where it is held at a pressure of between about 3–20 bar, and is treated for between 10–60 minutes. Pulp reacts with the peroxide so that there is less than 5 kg of hydrogen peroxide per ton of pulp remaining, and then between about 40–90% of the gas is separated from the pulp at or adjacent discharge of the pulp from the first vessel. The pulp is then passed to a second substantially-unpressurized bleaching tower having an interior volume at least about twice as great as the first vessel. The pulp is introduced into the bottom of the second vessel and flows upwardly in it and is discharged from adjacent the top of the second vessel. The pulp discharged from the top of the second vessel is passed to a second pretreatment stage substantially only under the influence of gravity (avoiding the need for a pump in the discharge).

18 Claims, 1 Drawing Sheet

METHOD OF BLEACHING CELLULOSE PULP WITH PEROXIDE UNDER ELEVATED PRESSURE IN A FIRST VESSEL AND ATMOSPHERIC PRESSURE IN SECOND VESSEL

BACKGROUND AND SUMMARY OF THE INVENTION

The present invention relates to a method of and system for bleaching cellulose pulp (most desirably kraft or other chemical or semi-chemical pulps) by using elemental chlorine free bleaching chemicals, and specifically to a new bleaching stage employing hydrogen peroxide.

Conventional peroxide bleaching has been performed in unpressurized, open towers designed for a treatment time of 1 to 4 hours, or in pressurized towers designed for a treatment time of 1 to 3 hours. An advantage of open towers is that they are fairly inexpensive and that there are often existing towers of that kind at mills. A disadvantage of open towers is that only a limited effective amount of peroxide, usually less than 20 kg $H_2O_2$, may be introduced into the pulp in them. Another disadvantage of open towers is the fact that when $H_2O_2$ decomposes and reacts, gas is formed, which is primarily oxygen gas. This gas causes flow problems in towers, thereby impairing the bleaching result.

An advantage of pressurized towers is that the gas is compressed, which decreases the flow problems. A drawback is that they are costly. A large pressure vessel for a 2 to 10 bar pressure has to be built. This is problematic, especially at big mills having a production exceeding 1500 tpd.

At prior art pulp mills (e.g., at Aspa Bruk in Sweden), peroxide bleaching stages according to FIG. 1 are presently used. These peroxide bleaching stages have a prereactor designed for a treatment time of approximately 10 to 30 minutes prior to the actual bleaching tower 12. Normally, the prereactor is supplied with oxygen, fed either through a pump 14 (shown in FIG. 1) or a specific mixer, and the bleaching tower 12 itself is supplied with peroxide. Towers have also been tested by feeding peroxide and/or oxygen to the prereactor 10 and then by continuing bleaching with peroxide in the tower 12 itself In some cases, the prereactor 10 has been pressurized. From the prereactor 10, a mixture of fiber suspension, bleaching chemicals, and reaction products has been conveyed to the actual bleaching tower 12, where an atmospheric pressure prevails, by feeding the fiber suspension to the tower 12 through the upper section thereof. The bleaching reaction continues in the tower 12 while pulp is slowly flowing downwardly. Bleached pulp is discharged from the bottom section of the tower 12 by means of a pump 16.

These processes, however, involve two problems. One of them is that when pulp is transferred to the actual bleaching tower 12, the gas produced as a byproduct of peroxide decomposing is also carried to the tower 12. The gas is bound with fibers to such an extent that it does not by become separated by natural forces and move to the upper section of the tower 12. Correspondingly, as the peroxide reaction continues in the bleaching tower 12, the decomposing peroxide produces gases in the tower 12. When the gas transferred from the prereactor 10 and the gas produced in the bleaching reactor 12 is separated from the pulp and seeks its way upwardly while the pulp is flowing downwardly, the flow pattern is disturbed, producing a poor bleaching result. The other problem is that, after the tower 12 a pump 16 or the like is necessary to forward pulp to the next stage.

According to the present invention the problems described above are solved in a surprisingly simple and inexpensive way. The method of the invention provides all advantages of a pressurized peroxide stage, with no need to build large pressure vessels. The method is most advantageous when the mill has existing bleaching towers which are changed to peroxide stages.

According to one aspect of the present invention a method of bleaching cellulose pulp using first and second bleaching towers, the second bleaching tower having an interior volume at least twice as great as the first vessel. The method comprises the following steps: (a) Mixing peroxide as the primary bleaching chemical, with the cellulose pulp. (b) Introducing the pulp from step (a) into the first vessel. (c) Maintaining the pressure in the first vessel between about 3–20 bar, for a treatment time of between about 10–60 min. so that the cellulose pulp reacts with the peroxide to such an extent that an amount of residual peroxide is about 5 kg $H_2O_2$ per ton of pulp, or less, the pulp including gas therein. (d) Separating between about 40–90% of the total volume of gas in the pulp substantially at the end of or after the practice of step (c), at a pressure exceeding about 3 bar. (e) Substantially solely under the influence of the pressure of the pulp from the first vessel passing the pulp to a lower portion of the second vessel. (f) Maintaining the second vessel at approximately atmospheric pressure, and so that the pulp flows upwardly in the second vessel to a top portion thereof And, (g) discharging the pulp from the top portion of the second vessel and passing it to a subsequent stage substantially only under the influence of gravity.

Step (a) is preferably practiced with a peroxide dosage of between about 5–30 kg/adt (perferably between about 7–15 kg/adt), and with the addition of some oxygen, up to about 20 kg/adt (preferably between about 5–10 kg/adt). During the practice of step (c) the temperature is typically held between about 60°–100° C., preferably between about 90°–100° C. The consistency of the pulp during all of the treatment steps is typically between about 8–20%, e.g., between about 10–15%. The height-to-diameter ratio of both of the first and second bleaching vessels, H/D, is preferably between about 5–15 (more preferably between about 9–11) in order to insure favorable flow conditions. The invention may be practiced utilizing alkali hydrogen peroxide, or acid peroxides (such as Caro's acid or peracid).

According to another aspect of the present invention, a system for bleaching cellulose pulp with peroxide is provided. The system comprises the following elements: A mixer for mixing cellulose pulp with peroxide bleaching chemical. An upflow first bleaching vessel maintained at superatmospheric pressure between about 3–20 bar having an inlet at the bottom thereof and an outlet at the top thereof, the inlet being connected to the mixer. A gas separating device disposed at or adjacent the first bleaching vessel outlet for separating between about 40–90% of the gas contained in the pulp at or adjacent the outlet from the first vessel. A second bleaching vessel having an internal volume at least twice as great as the first vessel, and having an inlet at a lower section thereof and an outlet at an upper section thereof A conduit devoid of pumping means between the gas separating device and the second bleaching vessel inlet for conducting pulp from the gas separating device to the second vessel. And, a discharge line from the second bleaching vessel outlet for discharging pulp from the second bleaching vessel, and devoid of a pump.

It is a primary object of the present invention to provide for the advantageous treatment of cellulose pulp with peroxide. This and other objects of the invention will become clear from an inspection of the detailed description of the invention and from the appended claims.

DETAILED DESCRIPTION OF THE DRAWINGS

Figure 1:
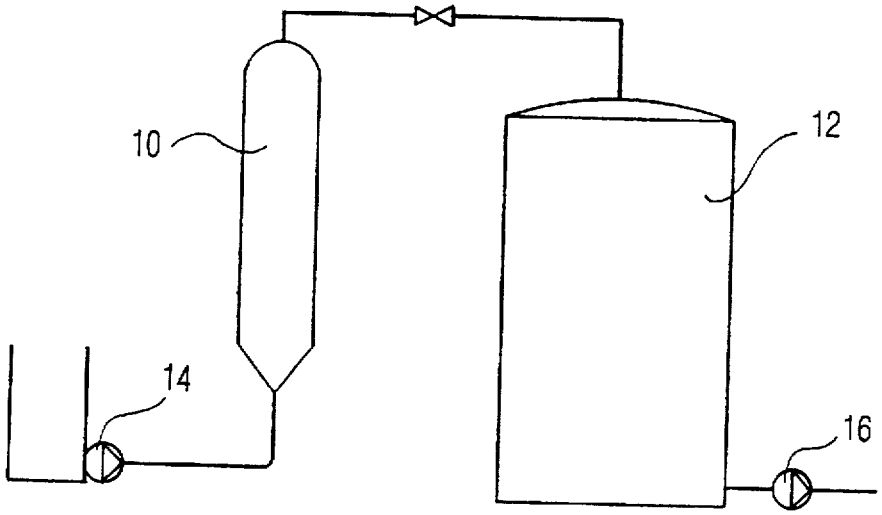
Fig. 1 (Prior Art)
FIG. 1 schematically illustrates a prior art peroxide bleaching plant.
Figure 2:
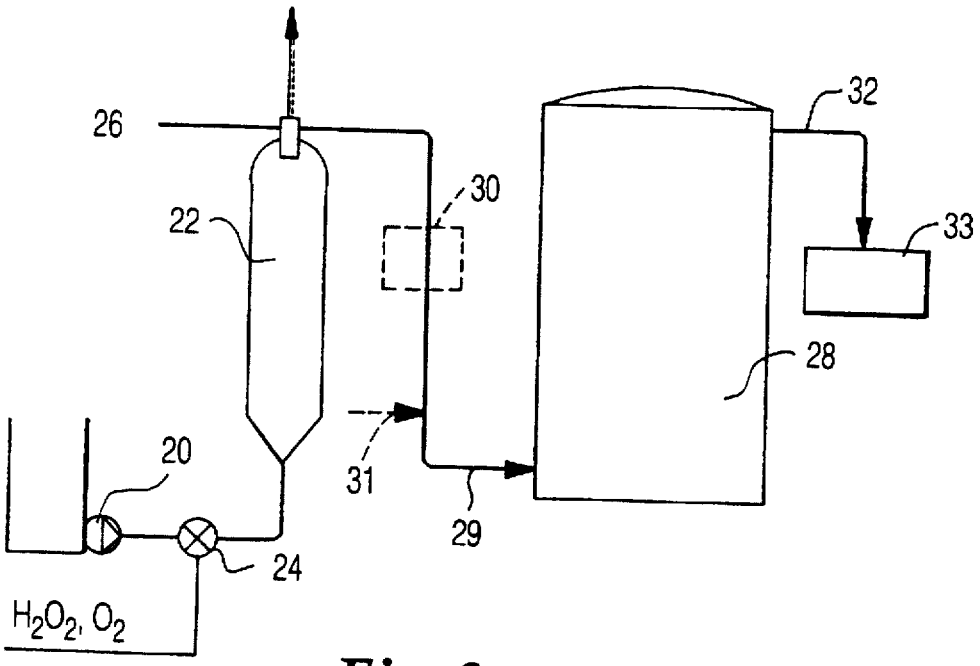
FIG. 2 schematically illustrates a bleaching stage/system in accordance with the invention.

In the method utilized in the peroxide bleaching stage/system of FIG. 2, pulp (e.g. kraft pulp) is pumped in a consistency range of between about 8 to 20% (e.g. between about 10–15%) with an MC® or other fluidizing pump 20 to a prereactor (first bleaching vessel) 22, which is designed for a treatment time of between about 10 to 60 minutes, preferably between about 20–40 minutes, most desirably about 30 minutes. The pressure in the prereactor 22 is between about 3 to 20 bar, preferably between about 7–13 bar, desirably about 10 bar. The bleaching chemicals primarily $H_2O_2$ and optionally oxygen are fed to pump 20 or to mixer 24. The peroxide dose is between about 5 to 30 kg/adt preferably between about 7–15 kg/adt., desirably about 10 kg/adt. The oxygen dose is usually 0 to 20 kg/adt, preferably between about 5 to 10 kg/adt. The temperature in the prereactor 22 is between about 60° to 100° C., preferably between about 90° to 100° C. Vessel 22 is connected to second bleaching vessel 28.

A suitable height/diameter ratio for the second bleaching vessel 28, and also for the prereactor 22, is H/D=between about 5–15, preferably between about 9–11. By using these dimensions, the tower 28 is provided with favorable flow conditions. The inlet 29 to tower 28 is usually conical.

In one specific example the height of the pressurized prereactor 22 was about 30 m and its diameter about 2.7 m. In a pilot plant, a test run was carried out by using a peroxide dose of about 18 kg $H_2O_2$/adt. After that prereactor 22, the kappa number was 4.5 and brightness 84. In a conventional unpressurized tower, the resulting kappa number was 5.5 and brightness 80. It was also noticed that there was a large volume of foam in the unpressurized tower 28 and that the level control of the tower 28 did not function properly. In the prereactor 22, peroxide reacts fast and, after about 30 minutes about 75% of the peroxide has been consumed. This also means that about 75% of the gas has been generated. If it is possible to get rid of this gas, there is no longer a need for pressurizing. It can be assumed that when the peroxide reaction has advanced to the state where the remaining amount of peroxide is less than about 5 kg/adt, the amounts of gas that are subsequently produced are so small that pressurizing is no longer necessary.

In accordance with this concept, a gas separator 26 is installed on top of the prereactor 22, for separating gas from the pressurized gas volume atop prereactor 22. The separating capacity of device 26 is between about 40 to 90% of the gas volume contained in the pulp. After gas separation in 26, the pulp (which is still in a pressurized state) is fed to the inlet 29 at the bottom of the bleaching tower 28, where the pulp flows upwardly by means of its own pressure without any separate pump. The bleaching tower 28 need not be pressurized, but rather may be any existing tank of a suitable size. A suitable treatment time in the bleaching tower 28 is between about 30 to 200 minutes, e.g. between about 60–120 minutes. Additional chemicals may be brought into the pulp between the prereactor 22 and tower 28 either via a mixer (shown schematically at 30) or, for example, by an injector (shown schematically at 31). After the bleaching reactions, pulp at the top of tower 28 flows, substantially solely by height difference (gravity), in line 32 to the next treatment stage 33 (e.g. a bleaching or washing stage) without the need for a pump.

In a practiced bleaching sequence the peroxide stage of FIG. 2 may be located, for example, as follows: Z - P/P - Z - P/P, i.e., the peroxide stage P/P may be in the beginning, middle, or, end of the sequence. In other words, a new peroxide stage in accordance with the invention may have an arbitrary place in the sequence.

The tower 28 typically has an interior volume at least twice as great (typically at least four times as great) as prereactor 22.

Although the invention has been described above to be applied to an alkali peroxide stage, corresponding techniques may as well be applied to acid peroxide stages, in which, e.g., Caro's acid or peracids are used. It has to be also noted that even though treatment stages prior to the peroxide stage have not been described above, it is evident that, for example, if the pulp contains heavy metals, such as iron or copper, they are removed from the pulp by, e.g., acidification and/or chelation prior to the peroxide stage.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of bleaching cellulose pulp with peroxide utilizing a first vessel having a first interior volume, and a second vessel having a second interior volume greater than the first volume, comprising the steps of:

(a) mixing about 7–15 kg/adt peroxide, as the primary bleaching agent, with the cellulose pulp;

(b) introducing the pulp from step (a) into the first vessel;

(c) maintaining the pressure in the first vessel between about 3–20 bar, for a treatment time of between about 10–60 min. so that the cellulose pulp reacts with the peroxide to such an extent that an amount of residual peroxide is about 5 kg $H_2O_2$ per ton of pulp, or less, the pulp including gas therein;

(d) separating between about 40–90% of the total volume of gas in the pulp substantially at the end of or after the practice of step (c), at a pressure exceeding about 3 bar;

(e) substantially solely under the influence of the pressure of the pulp from the first vessel passing the pulp to a lower portion of the second vessel;

(f) maintaining the second vessel at approximately atmospheric pressure, and so that the pulp flows upwardly in the second vessel to a top portion thereof; and (g) discharging the pulp from the top portion of the second vessel.

2. A method as recited in claim 1 wherein step (g) is practiced by passing the pulp to a subsequent bleaching stage substantially only under the influence of gravity.

3. A method as recited in claim 2 wherein step (a) is also practiced by mixing oxygen up to the amount of about 20 kg/adt with the pulp and peroxide.

4. A method as recited in claim 3 wherein step (a) is practiced by mixing between about 5–10 kg/adt of oxygen with the peroxide and pulp.

5. A method as recited in claim 3 wherein step (c) is further practiced by maintaining temperature in the first vessel between about 60°–100° C.

6. A method as recited in claim 4 wherein step (c) is further practiced by maintaining temperature in the first vessel between about 90°–100° C.

7. A method as recited in claim 3 wherein step (a) is practiced utilizing as the peroxide bleaching chemical alkali hydrogen peroxide, or acid peroxides.

8. A method as recited in claim 1 wherein step (a) is also practiced by mixing oxygen up to the amount of about 20 kg/adt with the pulp and peroxide.

9. A method as recited in claim 8 wherein step (a) is practiced by mixing between about 5–10 kg/adt of oxygen with the peroxide and pulp.

10. A method as recited in claim 1 wherein step (c) is further practiced by maintaining temperature in the first vessel between about 60°–100° C.

11. A method as recited in claim 1 wherein step (c) is further practiced by maintaining temperature in the first vessel between about 90°–100° C.

12. A method as recited in claim 1 wherein step (c) is practiced by causing the pulp to flow in the first vessel with a height-to-diameter ratio H/D of between about 5–15.

13. A method as recited in claim 12 wherein step (c) is practiced by causing the pulp to flow in the first vessel with a height-to-diameter ratio H/D of between about 9–11.

14. A method as recited in claim 13 wherein step (f) is practiced by causing the pulp to flow in the first vessel with a height-to-diameter ratio H/D of between about 9–11.

15. A method as recited in claim 12 wherein step (f) is practiced by causing the pulp to flow in the first vessel with a height-to-diameter ratio H/D of between about 5–5.

16. A method as recited in claim 1 wherein step (a) is practiced utilizing as the peroxide bleaching chemical alkali hydrogen peroxide, or acid peroxides.

17. A method as recited in claim 3 wherein step (a) is practiced utilizing as the peroxide bleaching chemical alkali hydrogen peroxide, or acid peroxides.

18. A method as recited in claim 1 wherein steps (a) through (g) are all practiced with said cellulose pulp at a consistency of between about 8–20%.

* * * * *